United States Patent [19]

Harris et al.

[11] 4,273,644

[45] Jun. 16, 1981

[54] PROCESS FOR SEPARATING BITUMINOUS MATERIALS

[75] Inventors: Samuel W. Harris; Jack W. Roach, both of Oklahoma City, Okla.

[73] Assignee: Kerr-McGee Refining Corporation, Oklahoma City, Okla.

[21] Appl. No.: 164,607

[22] Filed: Jun. 30, 1980

[51] Int. Cl.[3] ..... B65D 85/46

[52] U.S. Cl. ..... 208/321; 208/45; 208/309

[58] Field of Search ..... 208/45, 309, 358, 311, 208/321

[56] References Cited

U.S. PATENT DOCUMENTS

| | | | |
|---|---|---|---|
| 2,940,920 | 6/1960 | Garwin | 208/45 |
| 3,403,093 | 9/1968 | Mills | 208/45 |
| 3,830,732 | 8/1974 | Gatsis | 208/309 |
| 4,017,383 | 4/1977 | Beavon | 208/309 |
| 4,101,415 | 7/1978 | Crowley | 208/45 |
| 4,125,459 | 11/1978 | Garwin | 208/309 |
| 4,211,633 | 7/1980 | Gleim | 208/309 |

*Primary Examiner*—Brian E. Hearn

*Attorney, Agent, or Firm*—William G. Addison

[57] ABSTRACT

A process for separating a solvent from a bituminous material by pressure reduction and steam stripping without carry-over of entrained bituminous material. A fluid-like phase comprising bituminous material and solvent is reduced in pressure by passage through a pressure reduction valve to vaporize a portion of the solvent. The reduction in pressure also results in dispersing a mist of fine bituminous material particles in the vaporized solvent. The stream of vaporized solvent, mist and fluid-like bituminous material then is introduced into a static mixer. The static mixer intimately mixes the mist with the fluid-like material and causes the mist to recombine with the fluid-like material from which it was formed. The resulting stream is introduced into a steam stripper to separate the solvent remaining in the bituminous material. The vaporized solvent and steam are withdrawn from the stripper substantially free of entrained bituminous material and condensed. The liquid stream is introduced into a solvent surge vessel having a water draw. The solvent then is recycled in the process.

11 Claims, 1 Drawing Figure

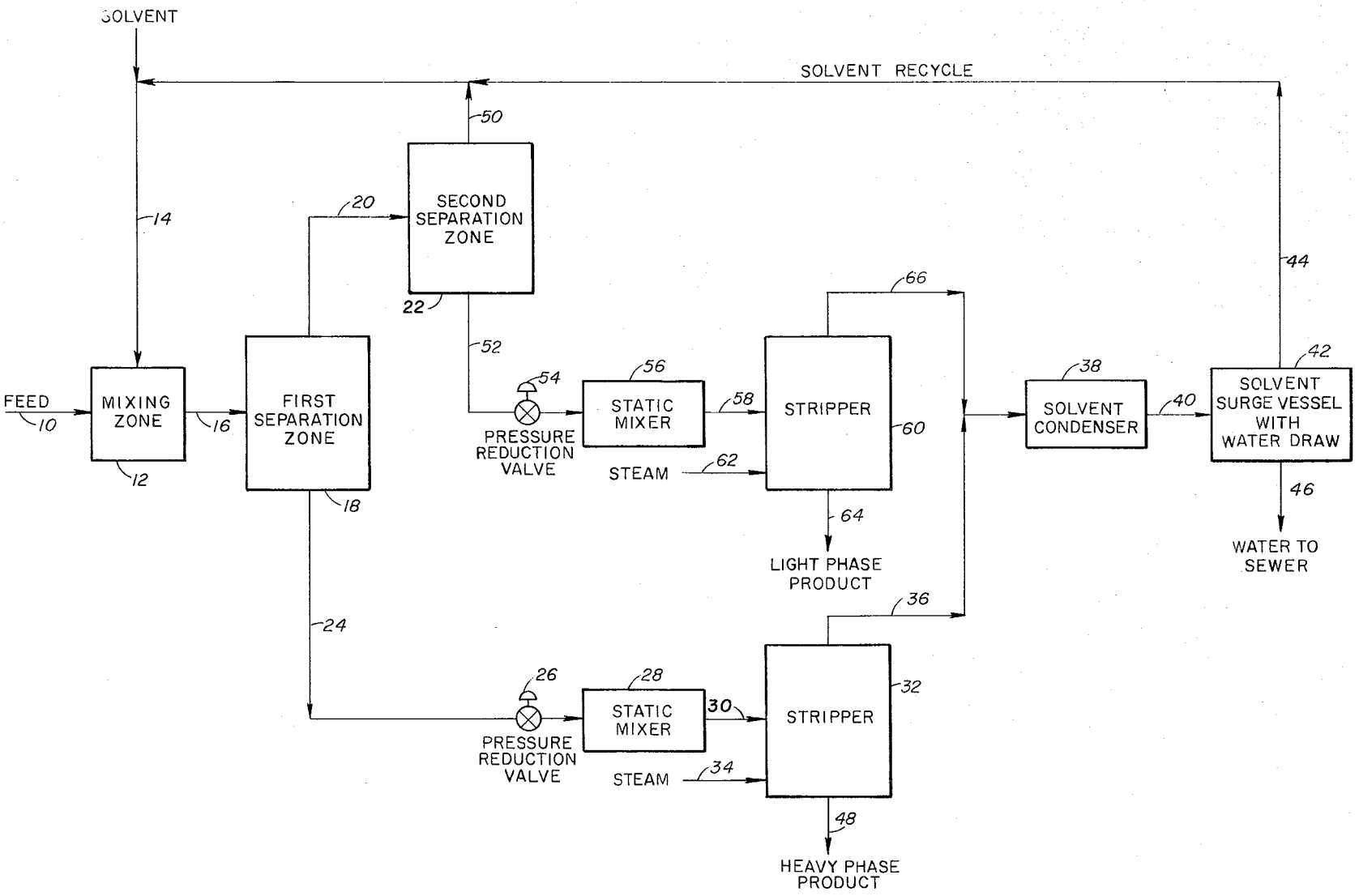
SOLVENT
FEED
10
MIXING ZONE
12
14
16
FIRST SEPARATION ZONE
18
20
SECOND SEPARATION ZONE
22
50
52
54
PRESSURE REDUCTION VALVE
STATIC MIXER
56
58
STEAM
62
STRIPPER
60
64
LIGHT PHASE PRODUCT
66
SOLVENT CONDENSER
38
40
SOLVENT SURGE VESSEL WITH WATER DRAW
42
44
46
WATER TO SEWER
SOLVENT RECYCLE
24
26
PRESSURE REDUCTION VALVE
STATIC MIXER
28
30
STEAM
34
STRIPPER
32
36
48
HEAVY PHASE PRODUCT

PROCESS FOR SEPARATING BITUMINOUS MATERIALS

BACKGROUND OF THE INVENTION

1. Field of the Invention

This invention relates to a improved process for separating bituminous materials into various fractions employing solvents at elevated temperatures and pressures.

2. Brief Description of the Prior Art

Many methods for extracting various fractions from bituminous materials have been disclosed previously in the prior art, perhaps the most well known of these being termed "propane extraction" in which asphaltic materials are extracted or recovered from heavy hydrocarbon materials such as reduced crudes by means of a single solvent extraction step using propane as the extractant.

U.S. Pat. No. 2,940,920, assigned to the same assignee as the present invention, discloses that solvents other than propane can be used to separate heavy hydrocarbon materials into at least two fractions at a greatly improved rate of separation and in a manner which eliminates certain prior art operating difficulties encountered in the use of propane type solvents ($C_2$ to $C_4$ hydrocarbon solvents). That patent discloses effecting the separation by using high temperature-pressure techniques and by using pentane as one of a group of suitable solvents. Such practice permits a deeper cut to be made in the heavy hydrocarbon material.

U.S. Pat. No. 4,125,459, assigned to the same assignee as the present invention, discloses a process for separating a heavy hydrocarbon material into three fractions by using a combination of propane and pentane deasphalting techniques. That process includes (i) mixing the heavy hydrocarbon material with pentane at elevated temperatures and pressures to produce a light fraction containing resins and oils, (ii) mixing the light fraction with propane at high temperatures and pressures to produce a second light fraction comprising oils and a second heavy fraction comprising resins and (iii) recycling at least a portion of the resins fraction back to the pentane deasphalting process. Alternatively, that process may be carried out by subjecting the heavy hydrocarbon material first to a propane deasphalting process to produce a heavy fraction containing asphaltenes and resins, followed by a pentane deasphalting process on the asphaltene-resin fraction previously obtained to produce a second light fraction comprising resins and a second heavy fraction comprising asphaltenes and recycling at least a portion of the resins fraction back to the propane deasphalting process.

U.S. Pat. No. 3,830,732 discloses a two solvent extraction process for producing three fractions from a hydrocarbon charge stock containing asphaltenes, resins and oils. The charge stock is admixed with a first solvent in a volumetric ratio of solvent to charge stock of less than about 4:1 to form a mixture that is introduced into a first extraction zone maintained at an elevated temperature and pressure. The mixture separates within the first extraction zone to produce a first solvent-rich liquid phase containing oils which are free of asphaltenes and resins and a first solvent-lean liquid phase containing asphaltenes and resins. The solvent-lean liquid phase then is contacted with a second solvent containing at least one more carbon atom per molecule than said first solvent and introduced into a second extraction zone. The second extraction zone is maintained at a lower temperature and pressure than the first extraction zone to separate the solvent-lean liquid phase into a second solvent-rich liquid phase containing resins and a second solvent-lean liquid phase containing asphaltenes.

U.S. Pat. No. 4,101,415 discloses a single solvent extraction process for separating a heavy hydrocarbon material into three different fractions by a process employing a two stage solvent treatment wherein different solvent to feed ratios and different temperatures are used in each stage. The charge stock is admixed with the solvent in a volumetric ratio of solvent to feed in the range of 2:1 to 10:1 and introduced into a first extraction zone maintained under temperature and pressure conditions sufficient to cause the mixture to separate into a first solvent-rich fraction containing oils and a first solvent-lean fraction containing asphaltenes and resins. The solvent-lean fraction then is contacted with an additional portion of the solvent and introduced into a second extraction zone maintained at a temperature and pressure lower than in the first extraction zone to cause asphaltic solids to form. The soluble material then is separated from the asphaltic solids.

In many of the prior art separation processes, the solvent is separated from the various products by either or both pressure reduction and steam stripping. The solvent is vaporized by such treatment, separated from the bituminous product and condensed for recycle in the separation process.

It has been observed that in some instances a portion of the bituminous material introduced into the steam stripping apparatus is carried out of the steam stripper in the form of fine particles with the vaporized solvent and steam. When the solvent and steam are condensed, the fine particles solidify and settle within the process apparatus. The settling solids ultimately plug the apparatus and cause a disruption of the bituminous separation process.

SUMMARY OF THE INVENTION

The discovery now has been made that it is possible to separate a solvent from a bituminous material by pressure reduction and steam stripping without carry-over of fine bituminous material particles to the solvent recovery apparatus. The process comprises introducing the separated stream of solvent and bituminous material into a static mixer following pressure reduction and prior to entry into the steam stripping apparatus.

Initially, a bituminous feed is admixed with a solvent and introduced into a first separation zone. The first separation zone is maintained at an elevated temperature and pressure to effect a separation of the mixture into a fluid-like first light phase comprising light bituminous material and solvent and a fluid-like first heavy phase comprising heavy bituminous material and solvent. The first light phase is withdrawn from the first separation zone and introduced into a second separation zone for additional processing.

The first heavy phase is withdrawn from the first separation zone and reduced in pressure by passage through a pressure reduction valve. The reduction in pressure causes a substantial portion of the solvent in the first heavy phase to vaporize. Unfortunately, the pressure reduction also results in the formation of an undesirable fine particle size mist of a portion of the heavy bituminous material. The resultant mixture of vapor, mist and fluid-like material then is introduced into a static mixer. The static mixer intimately mixes the mist with the fluid-like material and causes the mist to recombine with the fluid-like material from which it was formed. The resulting stream then is introduced into a steam stripper for separation of the solvent remaining in the fluid-like material. The solvent remaining dissolved in the fluid-like material is vaporized by the steam. The vaporized solvent and steam then are withdrawn from the steam stripper and introduced into a solvent condenser. The solvent vapor and steam are condensed and the resultant liquid stream is withdrawn from the solvent condenser and introduced into a solvent surge vessel having a water draw. Because of the difference in density between the solvent and water, the water separates as a heavy layer and is withdrawn from the bottom of the solvent surge vessel while the solvent is recycled in the process.

The recombination of the mist with the fluid-like material prior to steam stripping eliminates the possiblity of fine particle carry-over from the steam stripper into the solvent condenser or solvent surge vessel.

BRIEF DESCRIPTION OF THE DRAWING

The single FIGURE is a diagrammatic illustration of the process of this invention.

DESCRIPTION OF THE PREFERRED EMBODIMENT

Turning now to the drawing, a feed stock comprising a bituminous material is introduced into a mixing zone 12 through a conduit 10. A solvent is introduced into mixing zone 12 through a conduit 14 to contact and admix with the feed to provide a feed mixture. Sufficient solvent is introduced into mixing zone 12 to provide a ratio by volume of solvent to feed in the mixture in the range of from about 2:1 to about 20:1 and preferably in the range of from about 8:1 to about 12:1. It is to be understood that larger quantities of solvent may be used, but such use is unnecessary.

To facilitate an understanding of the process of the present invention, and not by way of limitation, hereinafter specific reference will be made to a bituminous feed comprising an atmospheric residuum containing asphaltenes, resins and oils. The feed mixture comprising atmospheric residuum and solvent is withdrawn from mixing zone 12 an introduced into a first separation zone 18 via a conduit 16. The first separation zone 18 is maintained at an elevated temperature and pressure to effect a separation of the feed mixture into a fluid-like first light phase comprising oils and solvent and a fluid-like heavy phase comprising asphaltenes, resins and solvent.

More particularly, first separation zone 18 is maintained at a temperature level in the range of from about 150 degrees F. to above the critical temperature of the solvent. The pressure level of first separation zone 18 is maintained at least equal to the vapor pressure of the solvent when zone 18 is maintained at a temperature below the critical temperature of the solvent and at least equal to the critical pressure of the solvent when maintained at a temperature equal to or above the critical temperature of the solvent. Preferably the pressure level is maintained above the critical pressure of the solvent.

In an alternate embodiment of the invention (not shown), the feed in conduit 10 and solvent in conduit 14 are introduced directly into first separation zone 18 without prior mixing. Preferably, the feed is introduced into an upper portion of first separation zone 18 and the solvent is introduced into a lower portion of first separation zone 18. The solvent and feed are introduced in the same general volumetric ratios as previously described. The solvent admixes with the feed within first separation zone 18 and the mixture then is caused to separate into the fluid-like first light phase and fluid-like first heavy phase through control of the temperature and pressure within zone 18.

Referring again to the drawing, the first heavy phase is withdrawn from first separation zone 18 through a conduit 24 and reduced in pressure by passage through a pressure reduction valve 26 interposed in conduit 24. Preferably, the pressure level of the first heavy phase is reduced to a level of from about 0 to 50 psig. The pressure reduction vaporizes a substantial portion of the solvent in the first heavy phase, however, a small quantity of solvent remains dissolved in the fluid-like mixture of asphaltenes and resins. It has been observed that the pressure reduction or flashing process which results in vaporization of the solvent also results in the undesirable formation of a fog or mist of fine particle size asphaltenes and resins. The particles are dispersed within the vaporized solvent such that they do not readily recombine with the fluid-like asphaltenes and resins.

It has been found that the fine particles dispersed in the vaporized solvent solidify upon condensation of the solvent and settle within the solvent condenser and other subsequent apparatus. The settling particles of bituminous material accumulate within the apparatus and ultimately plug the withdrawal conduits causing disruption of the bituminous separation process.

In accordance with the process of the present invention, the mixture of vaporized solvent, fine particle size asphaltenes and resins and fluid-like asphaltenes and resins resulting from the pressure reduction is introduced into a static mixer 28. In static mixer 28, the mixture is intimately mixed and the fine particle size asphaltenes and resins are caused to substantially recombine with the fluid-like asphaltenes and resins. The vaporized solvent and fluid-like asphaltenes and resins then flow from the static mixer 28 by a conduit 30 to a steam stripper 32.

In the event that the pressure reduction of the heavy phase results in cooling which lowers the temperature of the solvent in the heavy phase to a level below its dew point, a heater can be interposed in conduit 24 in advance of pressure reduction valve 26 to heat the heavy phase to a higher temperature prior to pressure reduction. The benefit of such heating is a reduction in the total energy that then must be added by steam stripper 32 to vaporize the liquid solvent which would otherwise be present.

In steam stripper 32, the vaporized solvent, now substantially free of fine particle size asphaltenes and resins, separates from the fluid-like asphaltenes and resins and rises to an upper portion of steam stripper 32. The asphaltenes and resins settle within the apparatus and collect in a bottom portion of steam stripper 32. Steam is introduced into the bottom portion of stripper 32 by a conduit 34. The steam rises upwardly through the settling asphaltenes and resins and causes at least a portion of any remaining solvent associated therewith to be vaporized. The asphaltenes and resins are withdrawn from the bottom portion of stripper 32 through a conduit 48 for recovery. The vaporized solvent and steam are withdrawn from steam stripper 32 through a conduit 36 and introduced into a solvent condenser 38.

In solvent condenser 38, the vaporized solvent and steam are condensed into a liquid mixture substantially free of fine particle size asphaltenes and resins. The liquid mixture is withdrawn from solvent condenser 38 through a conduit 40 and introduced into a solvent surge vessel 42 which has a water draw.

In surge vessel 42 the solvent separates from the water as a result of the difference in fluid densities and the solvent is withdrawn through a conduit 44 for recycle in the process. The separated water which has a density greater than that of the solvent is withdrawn from the bottom of surge vessel 42 through a conduit 46 and can be sewered or disposed of in any other suitable manner.

The separated first light phase is withdrawn from the first separation zone 18 through a conduit 20 and introduced into a second separation zone 22. In one particular embodiment, the second separation zone 22 is maintained at a temperature level higher than the temperature level in the first separation zone 18 and at an elevated pressure to effect a separation of the first light phase into a second light phase comprising solvent and a fluid-like second heavy phase comprising oils and some solvent. The second light phase comprising solvent is withdrawn from second separation zone 22 through a conduit 50 for recycle in the process. The second heavy phase is withdrawn through a conduit 52 for additional treatment.

The second separation zone 22 is maintained at a temperature level in the range of from about 25 degrees F. above the temperature level in the first separation zone 18 to above the critical temperature of the solvent. The pressure level of second separation zone 22 is maintained at least equal to the vapor pressure of the solvent when zone 22 is maintained at a temperature below the critical temperature of the solvent and at least equal to the critical pressure of the solvent when maintained at a temperature equal to or above the critical temperature of the solvent. The pressure level in the second separation zone 22 can be substantially the same pressure level as is maintained in first separation zone 18.

In another embodiment also illustrated by the drawing, the feed is admixed with the solvent in mixing zone 12 and introduced into the first separation zone 18 as hereinbefore described. In this instance, first separation zone 18 is maintained at a temperature level and pressure level determined to effect a separation of the feed mixture into a first light phase comprising oils, resins and solvent and a first heavy phase comprising asphaltenes and solvent.

The first heavy phase is withdrawn from first separation zone 18 through conduit 24 and treated as previously described to recombine any fine asphaltene particles that are dispersed in the solvent upon pressure reduction.

The first light phase is withdrawn from the first separation zone 18 through conduit 20 and introduced into second separation zone 22. The second separation zone 22 is maintained at a temperature level and pressure level determined to effect a separation of the first light phase into a second light phase comprising solvent and a second heavy phase comprising oils, resins and some solvent.

The second light phase comprising solvent is withdrawn from second separation zone 22 through conduit 50 for recycle.

The second heavy phase is withdrawn from second separation zone 22 through conduit 52 as previously described. In this instance, a pressure reduction valve 54 is interposed in conduit 52 to reduce the pressure of the second heavy phase. Preferably, the pressure level of the second heavy phase is reduced to a level of from about 0 to 50 psig. The pressure reduction vaporizes a substantial portion of the solvent in the second heavy phase, however, a small quantity of solvent remains. Unfortunately, the pressure reduction or flashing also results in the formation of an undesirable fog or mist of fine particle size resins and oils. The particles are dispersed in the vaporized solvent and do not readily recombine with the fluid-like resins and oils.

Previously, the fine particles dispersed in the vaporized solvent have been found to solidify upon condensation of the solvent for recycle in the process. The solidified particles settle within the solvent condenser and other subsequent apparatus. The settling particles accumulate within the apparatus and ultimately plug the withdrawal conduits causing disruption of the bituminous separation process.

In accordance with the process of the present invention, the mixture of vaporized solvent, fine particle size resins and oils and fluid-like resins and oils in conduit 52 is introduced into a static mixer 56. In static mixer 56, the mixture is intimately mixed and the fine particle size resins and oils are caused to substantially recombine with the fluid-like resins and oils. The vaporized solvent and fluid-like resins and oils then flow from the static mixer 56 by a conduit 58 to a steam stripper 60.

The solvent vapor separates from the fluid-like resins and oils and rises to an upper portion of stripper 60. The resins and oils settle within the apparatus and collect in a bottom portion of steam stripper 60. Steam is introduced into the bottom portion of stripper 60 by a conduit 62. The steam rises upwardly through the settling resins and oils and causes at least a portion of any remaining solvent associated therewith to vaporize. The resins and oils then are withdrawn from the bottom portion of stripper 60 through a conduit 64 for recovery.

The vaporized solvent and steam are withdrawn from stripper 60 through a conduit 66 for introduction into a solvent condenser and eventual recycle in the process. Advantageously, conduit 66 can connect to conduit 36 and the vaporized solvent and steam from stripper 60 can be combined with the vaporized solvent and steam from stripper 32 for introduction into solvent condenser 38. The solvent condenser 38 is operated as previously described to condense the solvent after which it then is separated from the condensed steam in solvent surge vessel 42 for recycle in the process.

In yet another embodiment of the invention (not shown) the mixture of feed and solvent is separated in a first separation zone into a first light phase comprising resins, oils and solvent and a first heavy phase comprising asphaltenes and some solvent. The first separation zone is maintained at an elevated temperature level and pressure level to effect the separation.

The first light phase is withdrawn from the first separation zone. The second separation zone is maintained at a temperature level and pressure level determined to effect a separation of the first light phase into a second light phase comprising oils and solvent and a second heavy phase comprising resins and some solvent. More particularly, the second separation zone is maintained at a temperature level higher than the temperature level in the first separation zone. The pressure level of the second separation zone is maintained at least equal to the vapor pressure of the solvent when the zone is maintained at a temperature below the critical temperature of the solvent and at least equal to the critical pressure of the solvent when maintained at a temperature equal to or above the critical temperature of the solvent.

The second light phase then is withdrawn from the second separation zone and introduced into a third separation zone. The third separation zone is maintained at a temperature and pressure level determined to effect a separation of the second light phase into a third light phase comprising solvent and a third heavy phase comprising oils and some solvent. More particularly, the third separation zone is maintained at a temperature level higher than the temperature level in the second separation zone. The pressure level of the third separation zone is maintained at least equal to the vapor pressure of the solvent when the zone is maintained at a temperature below the critical temperature of the solvent and at least equal to the critical pressure of the solvent when maintained at a temperature equal to or above the critical temperature of the solvent.

The first, second and third heavy phases are withdrawn from their respective separation zones and reduced in pressure to vaporize at least a portion of the solvent present and produce fluid-like asphaltene, resin and oil products prior to introduction into individual steam strippers to recover any remaining solvent. In the event the pressure reduction of the first, second or third heavy phase results in the formation of fine particle size asphaltenes, resins or oils, respectively, in the vaporized solvent, that particular heavy phase can be introduced into a static mixer prior to introduction into a steam stripper. The static mixer intimately mixes the vaporized solvent with the fluid-like product. The turbulent mixing causes the fine particle size material to recombine with the fluid-like product. The mixture of vaporized solvent and fluid-like product then is steam stripped, the fluid-like product recovered and the separated vaporized solvent and steam are condensed. The condensed solvent is recovered from the water and recycled in the process.

To illustrate the present invention and not by way of limitation, the following Examples are provided.

EXAMPLE I

Two tests are performed to determine the effect of the present invention upon a bituminous separation process.

In the first test, a feed comprising a low pressure crude oil fractionation tower bottoms product, otherwise referred to as atmospheric residuum, is contacted and admixed with a solvent comprising pentane in an amount sufficient to provide a solvent to feed ratio, by volume of 12:1. The feed mixture continuously is introduced into a first separation zone maintained at a temperature level of about 425 degrees F. and a pressure of about 650 psig. The feed mixture separates into a first light phase and a first heavy phase comprising asphaltenes, resins and solvent. The first heavy phase continuously is withdrawn from the first separation zone, passed through a pressure reduction valve, and introduced into a steam stripper at a pressure of about 115 psig. Steam is introduced into the lower portion of the steam stripper at a pressure of 225 psig. The steam strips solvent remaining in the asphaltenes and resins and the vaporized solvent and steam are withdrawn and introduced into a solvent condenser. The solvent and steam are condensed and then are introduced into a solvent surge vessel with a water draw. After 4 hours of continuous operation, the solvent surge vessel is inspected and is found to contain a deposit of fine particle size asphaltenes and resins which has collected therein and partially blocked the water drain conduit.

A second test then is run, in accordance with the process of this invention, by installing a static mixer in the conduit between the pressure reduction valve 26 and the steam stripper 32 (as shown in the drawing) and the solvent surge vessel is cleaned. The conditions are all maintained as in the first test. After 96 hours of continuous process operation the interior of the solvent surge vessel is inspected. The solvent surge vessel is found to contain no new deposit of asphaltenes and resins.

EXAMPLE II

Two tests are performed to determine the effect of the present invention upon a bituminous separation process.

In the first test, a feed comprising an atmospheric residuum is contacted and admixed with a solvent comprising pentane in an amount sufficient to provide a solvent to feed ratio, by volume of 12:1. The feed mixture continuously is introduced into a first separation zone maintained at a temperature level of about 250 degrees F. and a pressure of about 675 psig. The feed mixture separates into a first light phase comprising oils, resins and solvent and a first heavy phase comprising asphaltenes and solvent.

The first light phase continuously is withdrawn and introduced into a second separation zone. The second separation zone is maintained at a temperature level of about 425 degrees F. and a pressure level of about 650 psig. The first light phase is caused to separate into a second light phase comprising solvent and a second heavy phase comprising oils, resins and some solvent.

The second heavy phase continuously is withdrawn from the second separation zone, passed through a pressure reduction valve and introduced into a steam stripper at a pressure of about 20 psig. Steam is introduced into the steam stripper at a pressure of 225 psig. The steam strips solvent remaining in the oils and resins.

The vaporized solvent and steam are withdrawn from the stripper and introduced into a solvent condenser. The solvent and steam are condensed and the resultant liquid stream then is introduced into a solvent surge vessel with a water draw. After 4 hours of continuous operation, the solvent surge vessel is inspected and is found to contain a deposit of fine particle size resins which has collected therein and partially blocked the water drain conduit.

A second test then is run, in accordance with the process of this invention, by installing in the conduit between the pressure reduction valve 54 and the steam stripper 60 (as shown in the drawing) and the solvent surge vessel is cleaned. The conditions are all maintained as in the first test. After 96 hours of continuous process operation the interior of the solvent surge vessel is inspected. The solvent surge vessel is found to contain no new deposit of asphaltenes.

The foregoing Examples clearly illustrate the benefit which is to be derived from the use of the present invention. The present invention permits continuous operation of the bituminous separation process by coalescing the fog or mist of fine particles with the fluid-like portion of the heavy phase to thereby avoid carry-over of the fine particles into the solvent recovery apparatus of the process.

The term "bituminous material" as used herein means pyrogenous bitumens and native bitumens, one or more fractions or components thereof, products obtained by treating these materials or one or more of their components or fractions with air or another oxygen containing gas in the presence or absence of catalysts and products obtained by otherwise treating these materials. The pyrogenous bitumens include heavy or very low API gravity petroleum crudes, reduced crudes, either steam or vacuum refined, hard and soft wood pitches, coal tar residues, cracked tars, tall oil and the like. The native bitumens include gilsonite, wurtzilite, albertite and native asphalt, for instance, Trinidad asphalt and the like. Suitable catalysts include, for example, phosphorus pentoxide, ferric chloride, cobaltic salts and the like. The term "otherwise treating" as used herein includes, for example, condensation of asphalt-type material in the presence of a suitable treating agent to produce heavier or more complex materials. Examples of suitable treating agents are catalysts of the Friedel-Craft type.

The term "solvent" as used herein means a fluid comprising at least one member selected from the group consisting of: aromatic hydrocarbons having normal boiling points below 350 degrees F., such as benzene, toluene, o-, m- and p-xylene and isopropyl benzene; paraffin hydrocarbons containing from 3 through 9 carbon atoms, such as propane, butane, pentane, hexane, heptane, octane and nonane; mono-olefin hydrocarbons containing from 4 to 8 carbon atoms, such as butene, pentene, hexene, heptene and octene; and alcohols containing from 3 through 9 carbon atoms and the like.

While the present invention has been described with respect to what at present are preferred embodiments thereof, it will be understood, of course, that certain changes, substitutions, modifications and the like may be made therein without departing from its true scope as defined in the appended claims.

What is claimed is:

1. A process comprising:

separating an admixture comprising a fluid-like bituminous material and a solvent in a separation zone into at least a fluid-like light phase comprising a portion of said bituminous material and solvent and a fluid-like heavy phase comprising the remainder of said bituminous material and solvent by maintaining the admixture at an elevated temperature and pressure;

reducing the pressure on said heavy phase to vaporize at least a portion of the solvent present therein and form a mixture of fluid-like bituminous material in association with said vaporized solvent together with undesired fine particles of bituminous material dispersed therein;

introducing said mixture into a static mixer to cause said fine particles of bituminous material to coalesce by turbulent contacting with said fluid-like bituminous material in said mixture to form a coalesced mixture of fluid-like bituminous material in association with said vaporized solvent, said vaporized solvent of said coalesced mixture being substantially free of any fine particles of bituminous material;

introducing said coalesced mixture of fluid-like bituminous material in association with vaporized solvent into a steam stripper;

introducing steam into said steam stripper to contact said coalesced mixture to separate at least a portion of any nonvaporized solvent remaining therein and to form at least one stream comprising the fluid-like bituminous material and one other stream comprising vaporized solvent and steam; and recovering said vaporized solvent and steam from said steam stripper substantially free of any fine particle size bituminous material.

2. The process of claim 1 wherein the solvent comprises at least one member selected from the group consisting of aromatic hydrocarbons having normal boiling points below 350 degrees F., paraffin hydrocarbons containing from 3 through 9 carbon atoms, mono-olefin hydrocarbons containing from 4 to 8 carbon atoms, and alcohols containing 3 through 9 carbon atoms.

3. The process of claim 1 wherein the elevated temperature and pressure of the separation zone are defined further as a temperature in the range of from about 150 degrees F. to above the critical temperature of the solvent and a pressure at least equal to the vapor pressure of the solvent when maintained at a temperature below the critical temperature of the solvent and at least equal to the critical pressure of the solvent when maintained at a temperature equal to or above the critical temperature of the solvent.

4. A process comprising:

separating an admixture comprising a fluid-like bituminous material and a solvent in a first separation zone into at least a fluid-like first light phase comprising a portion of said admixture of bituminous material and solvent and a fluid-like first heavy phase comprising the remainder of said admixture of bituminous material and solvent by maintaining the admixture at an elevated temperature and pressure;

introducing said first light phase into a second separation zone maintained at a temperature level higher than the temperature in said first separation zone and at an elevated pressure level to effect a separation of said first light phase into a second light phase comprising solvent and a second heavy phase comprising bituminous material present in said first light phase and some solvent;

reducing the pressure on said second heavy phase to vaporize at least a portion of the solvent present therein and form a mixture of fluid-like bituminous material in association with said vaporized solvent together with undesired fine particles of bituminous material dispersed therein;

introducing said mixture into a static mixer to cause said fine particles of bituminous material to coalesce by turbulent contacting with said fluid-like bituminous material in said mixture to form a coalesced mixture of fluid-like bituminous material in association with said vaporized solvent, said vaporized solvent of said coalesced mixture being substantially free of any fine particles of bituminous material;

introducing said coalesced mixture of fluid-like bituminous material in association with vaporized solvent into a steam stripper;

introducing steam into said steam stripper to contact said coalesced mixture to vaporize at least a portion of any nonvaporized solvent remaining therein and to form at least one stream comprising said fluid-like bituminous material and one other stream comprising vaporized solvent and steam; and recovering said vaporized solvent and steam from said steam stripper substantially free of any fine particle size bituminous material.

5. The process of claim 4 wherein the solvent comprises at least one member selected from the group consisting of aromatic hydrocarbons having normal boiling points below 350 degrees F., paraffin hydrocarbons containing from 3 through 9 carbon atoms, monoolefin hydrocarbons containing from 4 to 8 carbon atoms, and alcohols containing 3 through 9 carbon atoms.

6. The process of claim 4 wherein the elevated temperature and pressure of the first separation zone are defined further as a temperature in the range of from about 150 degrees F. to above the critical temperature of the solvent and a pressure at least equal to the vapor pressure of the solvent when maintained at a temperature below the critical temperature of the solvent and at least equal to the critical pressure of the solvent when maintained at a temperature equal to or above the critical temperature of the solvent.

7. The process of claim 4 wherein the temperature and pressure of the second separation zone are above the critical temperature and pressure of the solvent.

8. A process comprising:

separating an admixture comprising (i) a fluid-like bituminous material comprising asphaltenes, resins and oils and (ii) a solvent in a separation zone into at least a fluid-like light phase comprising oils and solvent and fluid-like heavy phase comprising asphaltenes, resins and some solvent by maintaining the admixture at an elevated temperature and pressure;

reducing the pressure on said heavy phase to vaporize at least a portion of the solvent present therein and form a mixture of fluid-like asphaltenes and resins in association with vaporized solvent together with undesired fine particles of asphaltenes and resins dispersed therein;

introducing said mixture into a static mixer to cause said fine particles of asphaltenes and resins to coalesce by turbulent contacting with said fluid-like asphaltenes and resins in said mixture to form a coalesced mixture of fluid-like asphaltenes and resins in association with said vaporized solvent, said vaporized solvent of said coalesced mixture being substantially free of any fine particles of asphaltenes and resins;

introducing said coalesced mixture into a steam stripper;

introducing steam into said steam stripper to contact said coalesced mixture to vaporize at least a portion of any nonvaporized solvent remaining therein and to form at least one stream comprising the asphaltenes and resins and one other stream comprising vaporized solvent and steam;

recovering said vaporized solvent and steam from said steam stripper substantially free of any fine particle size asphaltenes and resins.

9. The process of claim 8 wherein the solvent comprises at least one member selected from the group consisting of aromatic hydrocarbons having normal boiling points below 350 degrees F., paraffin hydrocarbons containing from 3 through 9 carbon atoms, monoolefin hydrocarbons containing from 4 to 8 carbon atoms, and alcohols containing 3 through 9 carbon atoms.

10. The process of claim 8 wherein the elevated temperature and pressure of the separation zone are defined further as a temperature in the range of from about 150 degrees F. to above the critical temperature of the solvent and a pressure at least equal to the vapor pressure of the solvent when maintained at a temperature below the critical temperature of the solvent and at least equal to the critical pressure of the solvent when maintained at a temperature equal to or above the critical temperature of the solvent.

11. The process of claim 8 wherein the elevated pressure of the separation zone is above the critical pressure of the solvent.

* * * * *